United States Patent [19]

Bubik et al.

[11] Patent Number: 4,464,225

[45] Date of Patent: Aug. 7, 1984

[54] METHOD AND MACHINE FOR FABRICATING BUILDING BOARDS

[75] Inventors: Alfred Bubik, Ravensburg, Fed. Rep. of Germany; Oskar Kummer, Kriens; Burkard Rosenberg, Horw, both of Switzerland

[73] Assignee: Bell Maschinenfabrik AG, Kriens, Switzerland

[21] Appl. No.: 376,179

[22] Filed: May 7, 1982

Related U.S. Application Data

[63] Continuation of Ser. No. 189,103, Sep. 22, 1980, abandoned.

[30] Foreign Application Priority Data

Oct. 8, 1979 [CH] Switzerland ..... 9031/79

[51] Int. Cl.[3] ..... D21H 3/66

[52] U.S. Cl. ..... 162/181.6; 162/146; 162/154; 162/212; 162/216

[58] Field of Search ..... 162/152, 154, 153, 181.6, 162/216, 146, 291, 293, 336, 343, 342, 344, 347, 315, 212

[56] References Cited

U.S. PATENT DOCUMENTS

| | | | |
|---|---|---|---|
| 1,968,028 | 7/1934 | Clements | 162/344 |
| 2,177,643 | 10/1939 | Ferla | 162/154 |
| 2,718,824 | 9/1955 | Hornbostel | 162/344 |
| 2,732,296 | 1/1956 | Simpson | 162/154 |
| 2,764,917 | 10/1956 | Niks | 162/342 |
| 2,860,552 | 11/1958 | Corbin | 162/342 |
| 2,876,684 | 3/1959 | Fusco | 162/343 |
| 2,970,938 | 2/1961 | Erbach | 162/343 |
| 3,164,513 | 1/1965 | Calehuff | 162/343 |
| 3,725,197 | 4/1973 | Dahl et al. | 162/343 |
| 4,192,710 | 3/1980 | Bubik et al. | 162/343 |

FOREIGN PATENT DOCUMENTS

| | | | |
|---|---|---|---|
| 222219 | 5/1910 | Fed. Rep. of Germany | 162/342 |

*Primary Examiner*—Peter Chin

*Attorney, Agent, or Firm*—Werner W. Kleeman

[57] ABSTRACT

A method and machine for fabricating building boards or the like, especially asbestos cement plates, contains a turbulence device having at least one channel with a step-shaped widened portion. The channel either has the form of a slot extending over the entire width of the machine or there are provided a series of cylindrical bores forming essentially parallel channels. An intermediate chamber or compartment merges with the channel or channels. Leading from the intermediate chamber is an outlet gap to the upper surface of a felt band.

6 Claims, 7 Drawing Figures

METHOD AND MACHINE FOR FABRICATING BUILDING BOARDS

CROSS REFERENCE TO RELATED APPLICATION

This application is a continuation application of our commonly assigned, copending U.S. application Ser. No. 189,103, filed Sept. 22, 1980, now abandoned.

BACKGROUND OF THE INVENTION

The present invention relates to a new and improved construction of a machine for fabricating building boards or plates from a suspension of fibres and a curable material, and to an improved method of fabricating such building boards or plates.

Generally speaking, the machine of the present development is of the type containing an infeed line for the suspension and a movable band or belt for receiving thereon a layer of a mixture of fibres and the curable material formed from the suspension.

Building boards or plates, composed of a mixture of asbestos fibres and cement, are presently almost exclusively fabricated with machines containing a sieve cylinder which immerses within a container or vat containing the suspension. The aqueous suspension of the fibre material and the cement powder is dewatered due to a flow within the cylinder. The solid materials are retained at the surface of the cylinder and are removed therefrom by means of a felt band.

The prior art machines for fabricating the asbestos cement plates are afflicted with a spate of drawbacks. One of the most dominant ones of these is that a large proportion of the fine cement powder is entrained by the water flow through the sieve or screen of the sieve cylinder, and thus, is lost during the process of fabricating the plates. The fabricated plates therefore do not possess optimumly attainable strength values, especially have a poor ratio of strength in the transverse direction and lengthwise direction. The fibres are intensively aligned in the direction of rotation of the rotating sieve cylinder. Additionally, sieve or screen cylinders tend to become strongly contaminated, so that cleaning thereof is extremely complicated and time-consuming. The sieve or screen is a sensitive element and must be replaced within short time intervals.

SUMMARY OF THE INVENTION

Therefore, with the foregoing in mind it is a primary object of the present invention to provide a new and improved construction of a machine and method for the fabrication of building boards or plates, which is not associated with the aforementioned drawbacks and limitations of the prior art.

Another and more specific object of the present invention aims at providing a new and improved construction of machine and method for the production of such type building boards or plates which, in particular, is capable of producing plates having a more uniform alignment of the fibres in all directions, and thus, more uniform strength properties, additionally avoids the previously discussed loss of cement powder, and during operation is less sensitive than the state-of-the art machine.

Yet a further significant object of the invention is to provide an improved machine and method for the fabrication of building boards or plates which is capable of also processing suspensions of greater density than was heretofore the case, leading to considerable savings in energy during operation of the machine.

A further significant object of the present invention is to provide a new and improved construction of a machine for fabricating building boards or plates which is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the machine of the present development is manifested by the features that it has a turbulence device containing at least one channel equipped with a step-shaped widened portion leading into an intermediate chamber or compartment. An outlet or outfeed gap of the intermediate chamber leads to an upper surface of a movable band.

The inventive method of fabricating building plates from a suspension of fibers and a curable material, especially for the fabrication of fiber-reinforced cement plates, comprises the steps of providing a turbulence device containing at least one channel having a substantially step-shaped widened portion terminating in an outlet. A suspension composed of fibers and a curable material is fed through the turbulence device in order to subject the suspension to an intensive and uniform micro-turbulance. The suspension is delivered from the outlet of the turbulence device to an intermediate chamber in flow communication with the channel, and the suspension is then delivered from the intermediate chamber through the outlet gap and is deposited onto a movable band to form thereon a layer of a mixture from said suspension formed of the fibers and the curable material.

As mentioned, the turbulence device produces an intensive and uniform micro-turbulence of the suspension, so that the fibres, typically for instance asbestos fibres, in the cured material, normally an aqueous suspension of cement powder, are spatially aligned uniformly in all directions. From the intermediate compartment or chamber the suspension which is placed in a state of turbulence or agitation in this manner, arrives directly through the outlet gap upon the movable band, normally a felt band, where there is accomplished dewatering. The machine can work with an appreciably greater consistency of the suspension, for instance with 300 grams solids per liter liquid, in contrast to 100 grams solids per liter liquid as was heretofore the case. Additionally, the obtained product also has more uniform strength properties in the different directions, because of the uniform alignment of the fibres in all directions.

The intermediate chamber or compartment can possess the shape of a container having a free suspension surface or level. The thus formed machine is simple and easy to monitor during its operation, since the movement of the suspension is visible. Additionally, when the machine is placed out of operation, it is extremely easy to clean.

With such type of machine there can be arranged within the container, which forms the intermediate chamber or compartment, a further turbulence device or agitator in the form of a rotatable rod roll. By virtue of these measures there is maintained, even in fact possibly intensified, the intensive turbulence of the suspension in the intermediate chamber, and specifically, with relatively simple, readily accessible, easily replaceable and easy to clean means.

The outlet gap can be formed by the spacing between the band supported upon a guide roll and a counter roll. With such type arrangement there is especially avoided the danger of clogging of the outlet gap, since such is located between two surfaces which are moved in the outlet direction. At the same time the suspension which is deposited upon the band is subjected to a pressing or compaction operation by the guide roll and the counter roll. By virtue of this pressing operation there is formed a uniform thick layer when the band is consituted by a felt band.

According to another embodiment of the machine it is however possible to delimit the intermediate chamber by walls which converge at least in part and form by means of their edges the outlet gap. Such type machine has the notable advantage that it is particularly simple and robust in construction.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
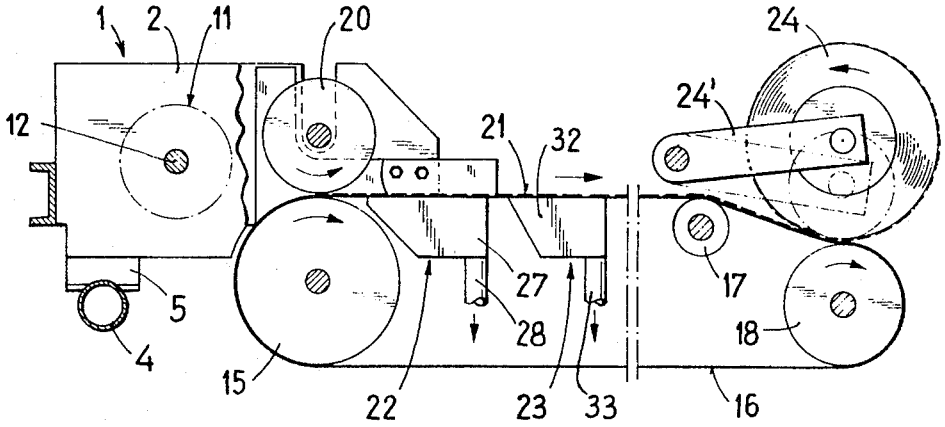
FIG. 1 is a schematic side view of a first exemplary embodiment of inventive machine for fabricating building boards or plates.
Figure 2:
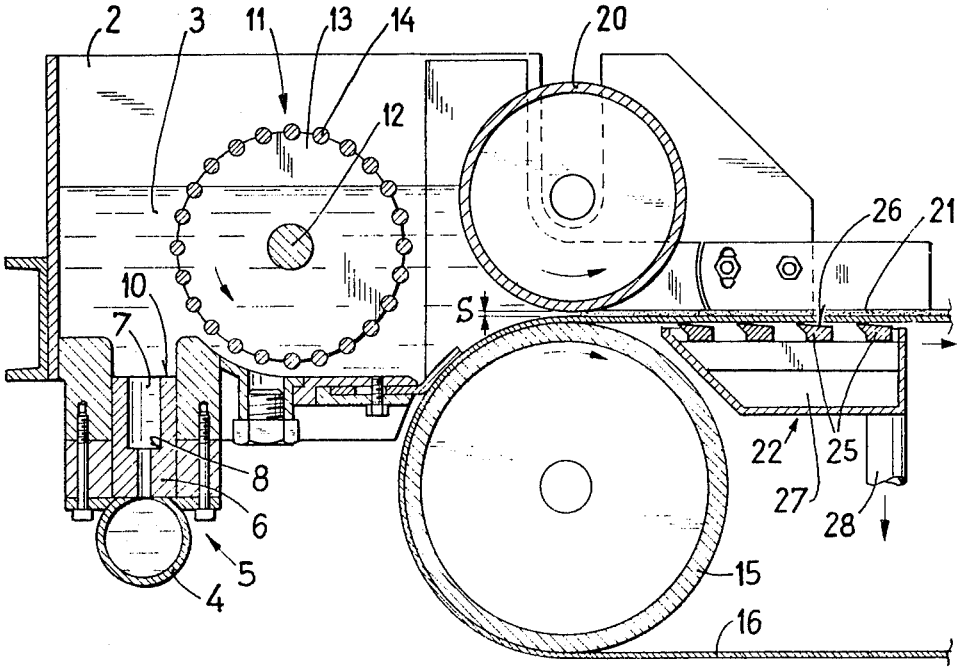
FIG. 2 is a fragmentary sectional view of the machine of FIG. 1 shown on an enlarged scale.

Describing now the drawings, the machine for fabricating building boards or plates—sometimes simply briefly referred to herein as boards or plates—, as shown in the embodiment of FIG. 1, will be seen to contain a molder or forming device 1 encompassing a container or vat 2, the internal space of which forms a chamber or compartment 3, as best seen by referring to FIG. 2. By means of an infeed line or conduit 4 there can be infed in conventional manner the prepared suspension which is used to fabricate the building boards or plates. As already mentioned, as a general rule this suspension is formed from cement and asbestos fibres in water. However, other suspensions can be used, such as, for instance, suspensions formed of synthetic fibres and cement or, in fact, fibres containing a different binder than cement.

The suspension flows out of the infeed line or conduit 4 into the chamber or compartment 3 through a turbulence device 5 which, in the arrangement under discussion, contains a perforated ledge member 6 having a series of essentially parallel bores or passages 7. Each of these bores 7 possesses a step-shaped widened portion 8. Also the transition of each bore 7 into a flat surface 10 of the perforated ledge member 6 forms a step-shaped widened portion.

At the step-shaped widened portions 8 and 10 there is formed, during the flow of the suspension, an intensive turbulence or agitation of the suspension, resulting in a uniform distribution of the fibres of the curable material and also a uniform alignment of the fibres in all directions.

This turbulence is maintained in the chamber 3 through the use of a so-called rod roll or cylinder 11, namely a cylinder or roll provided at its circumference with rod elements or rods 14 and defining an agitator. The rod roll 11 contains a shaft 12 which is mounted within the container or vat 2. As will be recognized by referring to FIG. 3 a drive motor 12' is operatively associated with the shaft 12 for placing the same into rotation. The shaft 12 carries two substantially disc or plate-shaped side walls 13 at which there are attached the rods 14 which extend essentially parallel to the shaft 12. The rod roll or cylinder 11 is placed into rotation in the direction of the arrow indicated in FIG. 2 during operation of the machine. Merging with the container 2 is a guide roll 15 of a felt band or belt 16 which is guided over further guide rolls 17 and 18. One of the guide rolls 15 or 18 is provided with a not particularly illustrated suitable drive.

Operatively associated with the guide roll 15 is a counter roll 20 which, together with the felt 16 which is supported upon the guide roll 15, forms an outlet or outfeed gap S. The material which effluxes through this outlet gap S from the chamber or compartment 3 forms a material layer 21 upon the felt or felt band 16, which can be dewatered with the aid of two suction devices 22 and 23. Finally, the material forming the layer 21 is wound onto a rotatable take-up or receiver roll 24 which is pivotably mounted, for instance, upon the pivotal support arms or levers 24'.

Figure 3:
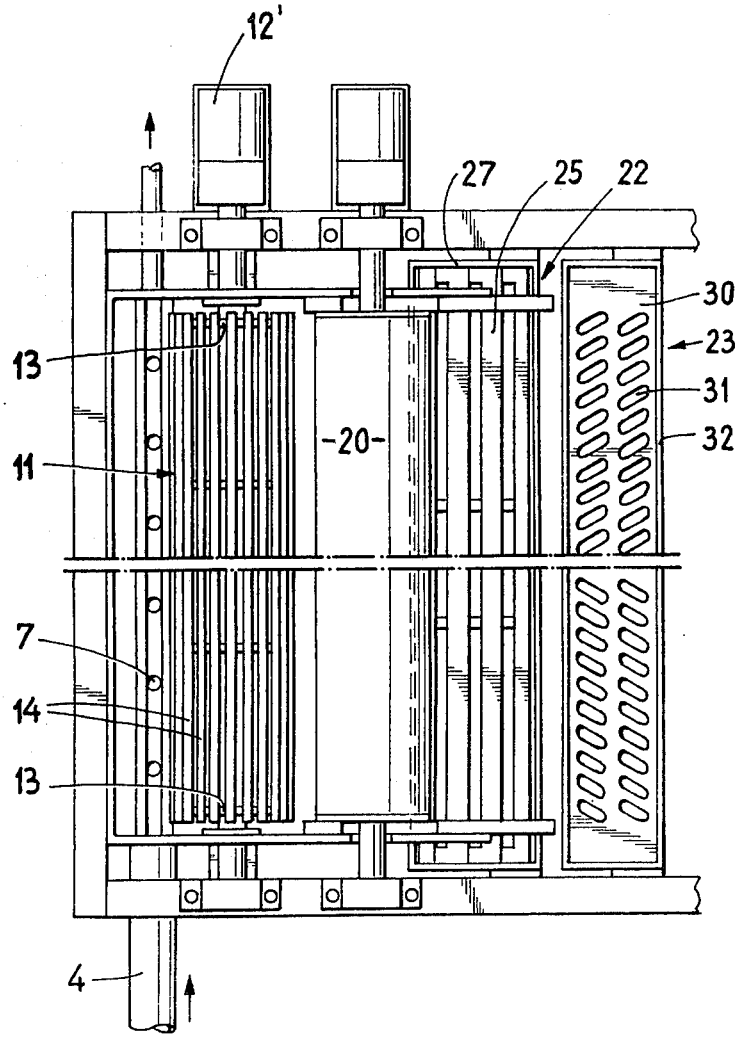
FIG. 3 is a top plan view of the arrangement of FIG. 2, however on a scale corresponding to that of FIG. 1.

As will be readily apparent by referring to FIGS. 2 and 3, the suction device 22 contains parallel suction ledges or ledge members 25 having inclined surfaces 26 which serve, during the movement of the felt band 16 in the direction of the indicated arrow, for the sucking-up of water out of the felt band 16. The sucked-up water arrives at a cabinet or box 27 of the equipment and can be withdrawn therefrom through a suitable tubular conduit or pipe 28 or equivalent structure.

The suction device 23 contains, according to the showing of FIG. 3, a guide plate 30 over which there is guided the felt or felt band 16. The guide plate 30 is provided with inclined slots 31 which render possible the outflow of the sucked-off water. The suction device 23, according to the showing of FIG. 1, contains a suction cabinet or box 32 from which leads a pipe or conduit 33 to a suction device which may be in the form of a vacuum pump.

Due to the different constructions of the suction devices 22 and 23 there is obtained a stepped suction action at the felt or felt band 16 and the material layer 21 located thereon, namely, initially a weaker suction action as long as the layer 21 still contains a great deal of water, and then a more intensified suction action after a major part of the water has been removed.

It should be understood that the suction devices 22 and 23 have only been schematically illustrated and that a random greater number of suction devices can be employed. Also, it is to be understood that dewatering devices of any other random suitable design may be beneficially employed in practicing the invention.

Figure 4:
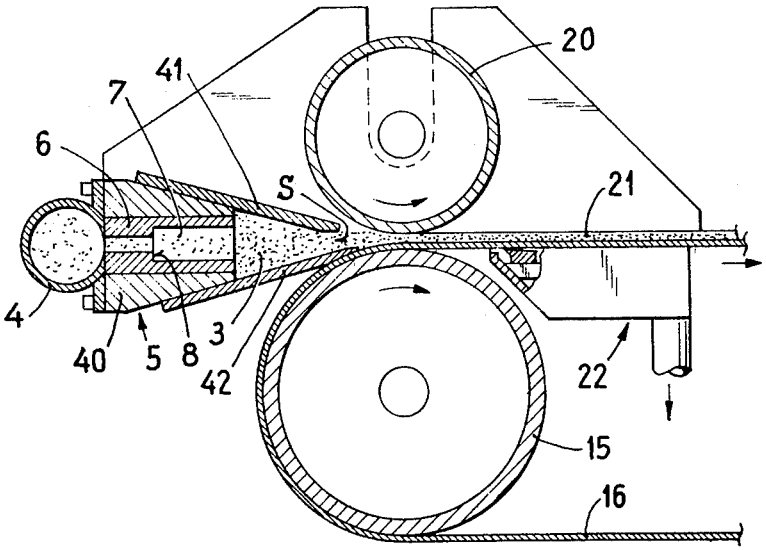
FIG. 4 is a sectional view of a further embodiment of machine, corresponding to the showing of FIG. 2.

FIG. 4 illustrates a further embodiment of inventive machine for the production of building plates. For reasons of simplifying the drawings, the components or parts which correspond to those of the machine of the embodiment of FIGS. 1 to 3 heretofore discussed, have been conveniently designated with the same reference characters.

With the apparatus shown in FIG. 4 the infeed line or conduit 4 is connected with a block 40 in which there is located a perforated or apertured ledge member 6 containing the bore 7. The intermediate chamber or compartment 3, in this case, is located between two convergingly arranged lip members 41 and 42 which collectively simultaneously form the outlet or outfeed gap or slice S. In this case, the counter roll 20 does not bound the outlet gap S, as was the case for the embodiment of FIG. 1 to 3, rather here it only serves for pressing together and smoothing the layer 21 emanating from the turbulence device 5 and which has been placed upon the felt belt or felt 16, and therefore, also, if desired, can be dispensed with.

With the embodiments of FIGS. 1 to 4 the turbulence or vorticity devices 5 contain a series of channels in the form of bores 7 having step-shaped widened portions 8. The bores 7 also can be, however, combined with a single channel having the form of a slot which extends over the entire width of the machine. Such type constructions have been illustrated in FIGS. 5, 6 and 7.

Figure 5:
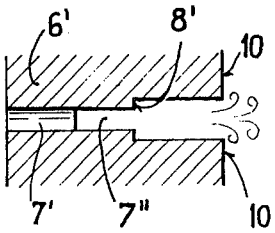
FIGS. 5, 6 and 7 constitute respective fragmentary sectional views illustrating different possible channel shapes of the machines shown in FIGS. 1 to 4.

According to the showing of FIG. 5 the perforated ledge member 6' contains a series of cylindrical bores 7' at which merges a slot 7'' extending over the entire width of the machine. The slot 7'' is provided with a widened portion 8', which in this case has the form of a step extending over the entire width of the machine. The end surface 10 of the perforated ledge member 6' thereafter forms a further step-shaped widened portion.

Figure 6:
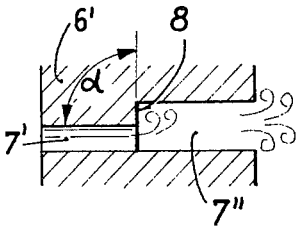

According to the embodiment of FIG. 6 the cylindrical bores 7' extend up to the widened portion 8 forming the transition to the slot 7''. In this case, the slot 7'' is arranged asymmetrically with respect to the lengthwise axes of the bores 7'.

Figure 7:
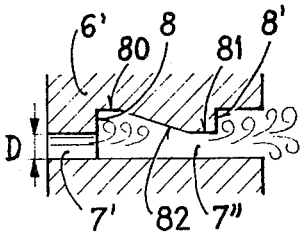

With the embodiment of FIG. 7 there are finally provided two widened portions 8 and 8', wherein the cylindrical bores 7' lead to the widened portion 8. Following the widened portion 8 and in front of the widened portion 8' there are formed surfaces 80 and 81, in the flow direction, these surfaces 80 and 80' extending essentially parallel to the direction of flow of the suspension within the slot 7''. Between both of the surfaces 80 and 81 there is located an inclined surface 82 which is selected such that the width of the slot 7'' is approximately equal to the diameter D of the bores 7''.

Although the step-shaped widened portions, illustrated in the drawings, always extend perpendicular to the lengthwise direction of the related channel (angle $\alpha$ in FIG. 6), it is also possible for this angle to deviate from 90° and to lie in a range of 45° to 135°.

Under circumstances the turbulence device also can contain only a single slot extending over the entire width of the machine, which, for instance, can be realised by omitting the bores 7' in FIG. 5 or by replacing the bores 7' in FIG. 6 and 7 by a continuous slot.

While there are shown and described present preferred embodiments of the invention, it is to be distinctly understood that the invention is not limited thereto, but may be otherwise variously embodied and practiced within the scope of the following claims. Accordingly,

What we claim is:

1. A method of fabricating building plates from a suspension of fibers and a curable material, especially for the fabrication of fiber-reinforced cement plates from an aqueous fiber cement slurry, comprising the steps of:

providing a turbulence device containing at least one channel having a substantially step-shaped widened portion terminating in an outlet and through which flows the aqueous fiber cement slurry;

infeeding a suspension composed of fibers and a curable material defining the aqueous fiber cement slurry through the substantially step-shaped widened portion of said turbulence device, in order to place said aqueous fiber cement slurry in a state of intensive and substantially uniform micro-turbulence;

delivering the aqueous fiber cement slurry through the outlet of the step-shaped widened portion and into an intermediate chamber in flow communication with the channel and containing therein an additional turbulence device defining an agitator acting upon the aqueous fiber cement slurry delivered from the outlet of said step-shaped widened portion;

providing a coacting pair of rolls defining therebetween an outlet gas for the intermediate chamber;

subjecting the aqueous fiber cement slurry to the action of the additional turbulence device within the intermediate chamber and prior to delivery of said aqueous fiber cement slurry through said outlet gap;

feeding said aqueous fiber cement slurry from said intermediate chamber through said outlet gap formed between said coacting pair of rolls;

depositing the aqueous fiber cement slurry effluxing out of said outlet gap between said coacting pair of rolls onto a movable band trained about one of said coacting pair of rolls, in order to form upon the movable band a layer of a mixture containing the fibers and the curable material of the aqueous fiber cement slurry; and dewatering the layer of the mixture containing the fibers and the curable material of the aqueous fiber cement slurry on the movable band so as to form a fiber-reinforced cement plate.

2. The method as defined in claim 1, further including the steps of:

providing a free suspension surface within the intermediate chamber.

3. The method as defined in claim 1, further including the steps of:

spatially aligning substantially uniformly in all directions the fibers by the action of the micro-turbulence.

4. The method as defined in claim 1, further including the steps of:

compacting the layer of the mixture which has been deposited upon the movable band.

5. The method as defined in claim 1, further including the steps of:

dewatering the layer of the mixture deposited upon the movable band by subjecting the layer to a suction action.

6. The method as defined in claim 5, wherein:

the suction action is applied to the layer so as to exert varying degrees of suction in the lengthwise extent of the layer.

* * * * *

UNITED STATES PATENT AND TRADEMARK OFFICE

CERTIFICATE OF CORRECTION

PATENT NO. : 4,464,225

DATED : August 7, 1984

INVENTOR(S) : ALFRED BUBIK et al

It is certified that error appears in the above—identified patent and that said Letters Patent is hereby corrected as shown below:

Column 6, line 24, delete "gas" and insert --gap--

Signed and Sealed this

*Fifteenth* Day of *January 1985*

[SEAL]

*Attest:*

GERALD J. MOSSINGHOFF

*Attesting Officer*

*Commissioner of Patents and Trademarks*